US006040517A

United States Patent [19]

Sakamoto

[11] Patent Number: 6,040,517

[45] Date of Patent: Mar. 21, 2000

[54] RHYTHMIC TONE GENERATOR

[75] Inventor: Yoshiaki Sakamoto, Tokyo, Japan

[73] Assignee: RIC Company, Ltd., Japan

[21] Appl. No.: 09/325,440

[22] Filed: Jun. 3, 1999

[30] Foreign Application Priority Data

Jun. 4, 1998 [JP] Japan ..... 10-170554
Mar. 3, 1999 [JP] Japan ..... 11-099192

[51] Int. Cl.[7] ..... G10H 1/40

[52] U.S. Cl. ..... 84/713; 84/651; 84/667; 84/600; 340/384.71

[58] Field of Search ..... 84/651–652, 665, 84/667–668, 711, 713–714, 600; 340/384 E, 384 R, 323, 323 R, 384.71; 58/130 E

[56] References Cited

U.S. PATENT DOCUMENTS

| | | | |
|---|---|---|---|
| 3,247,307 | 4/1966 | Campbell | 84/1.03 |
| 3,880,480 | 4/1975 | Greber | 340/323 |
| 4,164,732 | 8/1979 | Pischiera | 340/323 R |
| 5,127,301 | 7/1992 | Suzuki et al. | 84/600 |

*Primary Examiner*—Brian Sircus
*Assistant Examiner*—Marlon Fletcher
*Attorney, Agent, or Firm*—Rossi & Associates

[57] ABSTRACT

A rhythmic tone generator includes a casing that houses a rhythm signal generating circuit, a battery and a tone generating device, and that is positioned and held on the concha by an attaching device, so that the rhythmic tone generator is attached to the ear without being inserted into the ear hole, and operates to generate rhythmic tones right in the vicinity of the ear hole. On the rear surface of the casing are disposed a display device connected to the rhythmic tone generating circuit and operable to display a parameter representing the speed of the rhythm signal, and a push-button switch that may be operated with a hand while the tone generator is being attached to the ear. The rhythmic tone generating circuit is adapted to receive a command to start generation of rhythmic tones through an operation of pressing the switch, and set the speed of the rhythm signal through a procedure in which the user presses the switch to select it from plural parameter values successively displayed on the display device. The rhythm generating circuit generates the rhythm signal at the same speed that corresponds to the parameter value set in the last cycle, each time the circuit receives a command to start generating the rhythm tones through an operation to press the switch.

20 Claims, 11 Drawing Sheets

RHYTHMIC TONE GENERATOR

BACKGROUND OF THE INVENTION

1. Field of the Invention

The present invention relates to a rhythmic tone generator adapted to generate rhythmic tones with a small volume in the vicinity of the ear of a user, so as to help the user learn a rhythmical sense in dancing, abacus, swimming, typing, foreign language conversation, speech, sutra chanting, teeth brushing, golf swings, marathon, mountain climbing, jogging, and the like.

2. Description of the Prior Arts

U.S. Pat. No. 4,164,732 discloses a pacemaker equipped with a timer, wherein a display device for numerical values is used for displaying a content set in the pacemaker, and the remaining time is counted down through the same display device.

U.S. Pat. No. 4,337,529 shows a pacemaker incorporated in a wrist watch, which uses a limited number of switches for setting parameters associated with the rhythm, and also serves to give an alarm, using the timer.

Japanese Patent Publication No. 64-2228 discloses a metronome in which a plurality of different types of rhythm signals are registered or stored, and which allows one type of rhythm signal to be selected as needed.

Japanese Utility Model Laid-open Publication No. 62-1667 discloses a tone generator for use in golf practice, which operates to generate pulse tones in the timing corresponding to each of a series of steps executed in a golf swing.

Japanese Utility Model Laid-open Publication No. 63-65485 discloses a tone generator for use in golf practice, which operates to generate successive tones so as to express a pattern of a back swing as one step of a golf swing. In addition, the tone generator generates a plurality of preparation pulse tones prior to the start of the back swing.

Japanese Utility Model Laid-open Publication No. 4-50077 and Japanese Patent Laid-open Publication No. 7-280965 disclose a small-sized tone generating device for use in golf practice, which operates to generate rhythmic tones corresponding to respective steps of a golf swing, while it is attached to the concha or ear hole with the whole weight being supported by the ear.

It is desirable to reduce the weight of the above-described tone generating device that is to be attached to the ear and generate rhythmic tones for use during a golf swing or jogging. If the device has an undesirably large weight, the user may feel a pain at the ear, or the device may fall off from the ear, or its tone generating part may be shifted from the ear hole, when he/she shakes the head strongly, or makes intense vertical motions, or receives an impact.

If the device is made small in size, its weight may be easily reduced, and the device appears less recognizable by others. Further, the user is less likely to have a pain at the ear or feel uncomfortable due to the wear of the device.

If the size of the device is reduced, however, the handling ease and the freedom in selecting its appearance or designing the device are sacrificed, thus making the device less attractive in the market. In some example shown in the above-identified prior art references, it is even difficult for the device to start generating rhythmic tones while it is being attached to the ear, and a satisfactory handling ease cannot be achieved when the rhythm speed, or the like, is set or changed using a small dial.

Also, a known rhythmic tone generating device of the ear-hole insertion type is tightly inserted into the ear hole so that the self weight of the device can be supported within the ear hole. During use of this type of device, the user may feel more and more uncomfortable as time elapses after he/she starts wearing it, and even feel a severe pain at the ear due to poor blood circulation caused by a pressure on the wall of the ear hole if the user keeps wearing it for a long period of time. Also, the rhythmic tone generating device almost completely closes the ear hole, thus undesirably blocking the air flowing into and out of the ear hole. Where the tone generating device is used in summer or during an intense exercise, moisture may be caught inside the ear hole, possibly causing an itch or inflammation in the ear.

SUMMARY OF THE INVENTION

It is therefore a first object of the present invention to provide a rhythmic tone generator of ear attachment type, which is sufficiently reduced in the size and weight without deteriorating the handling ease and its appearance, thus rendering the device more attractive in the market.

It is a second object of this invention to provide a rhythmic tone generator that can be firmly attached to the ear without being inserted into the ear hole, thus making the tone generator even more attractive in the market.

It is a third object of this invention to provide a small-sized rhythmic tone generator to be attached to the ear, which can be operated with an improved handling ease that is an advantage in practical use.

To accomplish the above objects, the present invention provides a rhythmic tone generator that includes a casing comprising a head portion that may be placed in a recess around the ear hole and having a size that is larger than a diameter of the ear hole, and an arm portion that extends continuously from the head portion to the outside of an edge of the ear, and a clip that is coupled to a position of the arm portion located outside of the edge of the ear, and cooperates with a surface of the arm portion on the side of the ear to sandwich the concha in its thickness direction.

The casing houses a rhythmic tone generating circuit that generates a rhythm signal comprising a plurality of sets of pulses, a battery that supplies electric power to the rhythmic tone generating circuit, and a tone generating device that is driven by the rhythm signal to generate tones. With this arrangement, the rhythmic tone generator may be attached to the ear without being inserted into the ear hole, so as to generate the rhythmic tones in the vicinity of the ear hole.

The rhythmic tone generator constructed according to the present invention is a small-sized, light-weight device that is capable of generating rhythmic tones with a small volume right in the vicinity of the ear hole while the main body is being supported by the ear. The whole structure required to generate rhythmic tones is disposed in the main body, and operates by itself without relying on an external signal or electric power supplied from an external device.

Since the rhythmic tones are generated at a location very close to the ear hole, the user is able to hear the rhythmic tones comfortably even with a small volume, thus preventing the tone generator from disturbing others present around the user, or attracting attentions of others.

Further, the present rhythmic tone generator consumes only small electric power since the tones are generated with a small volume, thus assuring a prolonged battery life and permitting the use of a small-sized battery that also contributes to a reduction in the weight of the tone generator.

Since no part of the rhythmic tone generator is inserted in the ear hole and supported by the wall of the ear hole, the user is free from pain even during a long period of use, and moisture does not get caught inside the ear hole. In addition, since the rhythmic tone generator does not completely shut off external sound, the user does not fail to hear a horn of an automobile coming from the rear or an advice of someone else.

BRIEF DESCRIPTION OF THE DRAWINGS

The invention will be described in greater detail with reference to certain preferred embodiments thereof and the accompanying drawings, wherein.

DETAILED DESCRIPTION OF THE PREFERRED EMBODIMENTS

Figure 1:
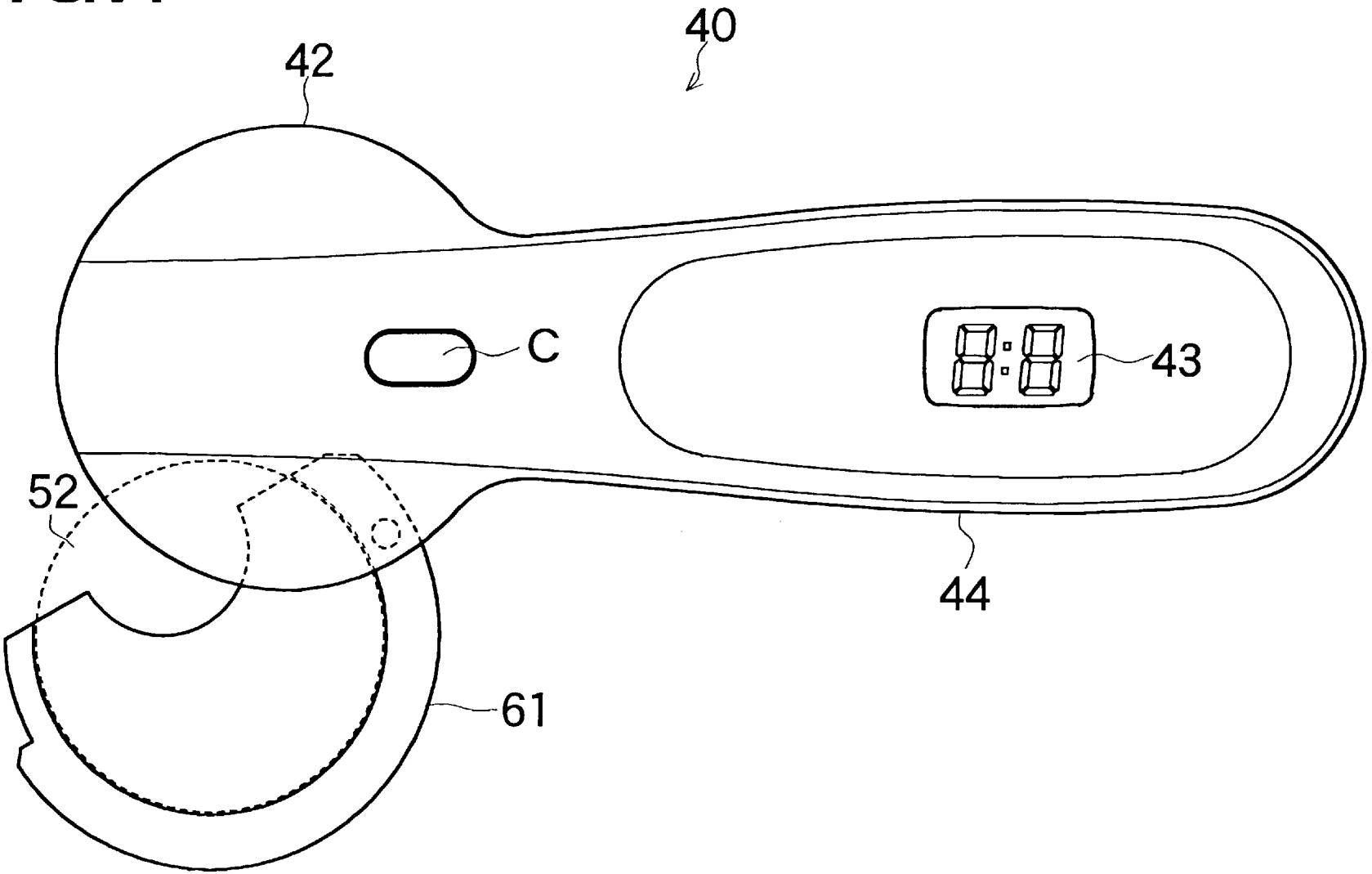
FIG. 1 is a plan view of a rhythmic tone generator according to the first embodiment of the present invention.
Figure 2:
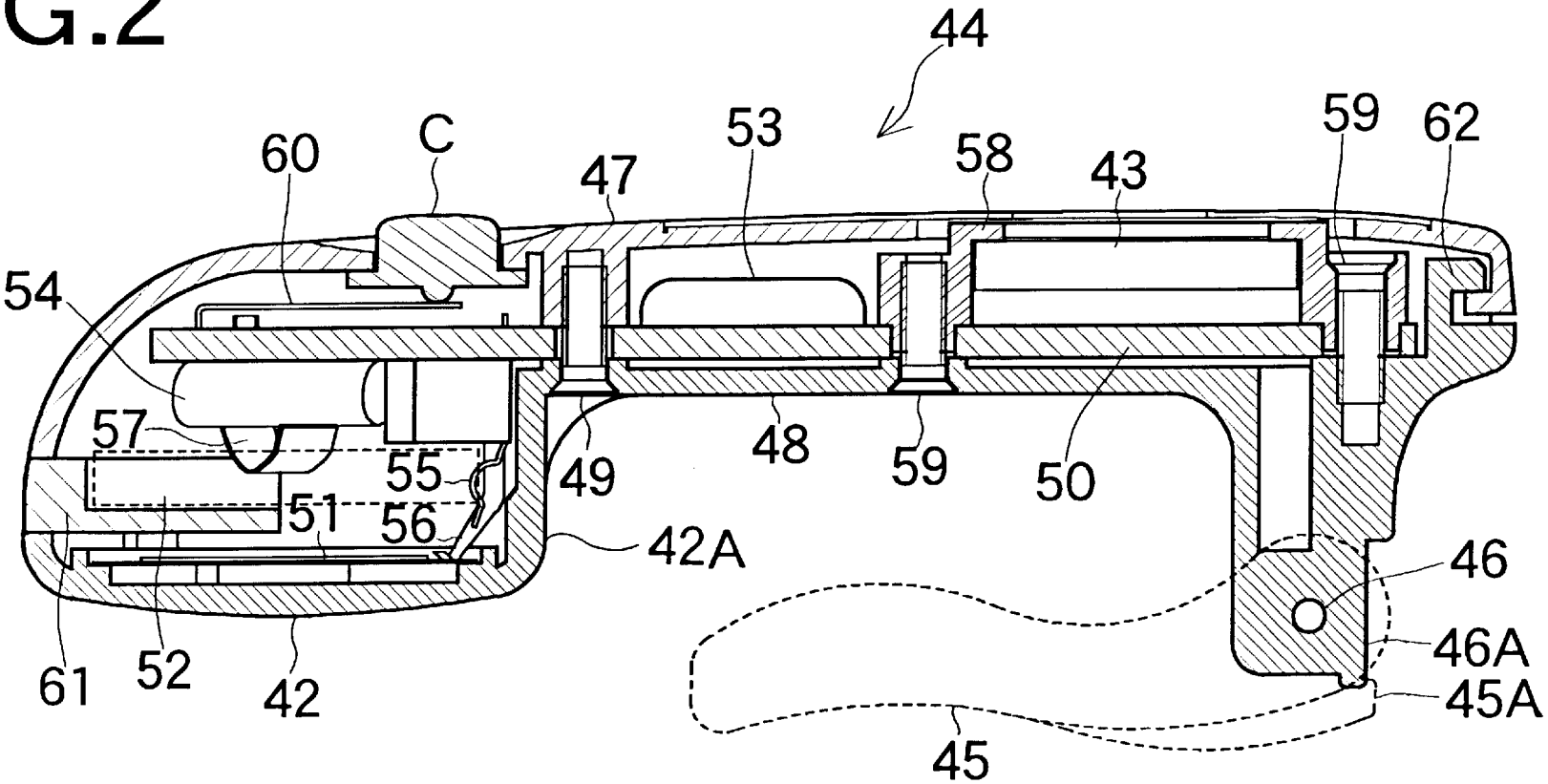
FIG. 2 is a cross-sectional view of the rhythmic tone generator.
Figure 3:
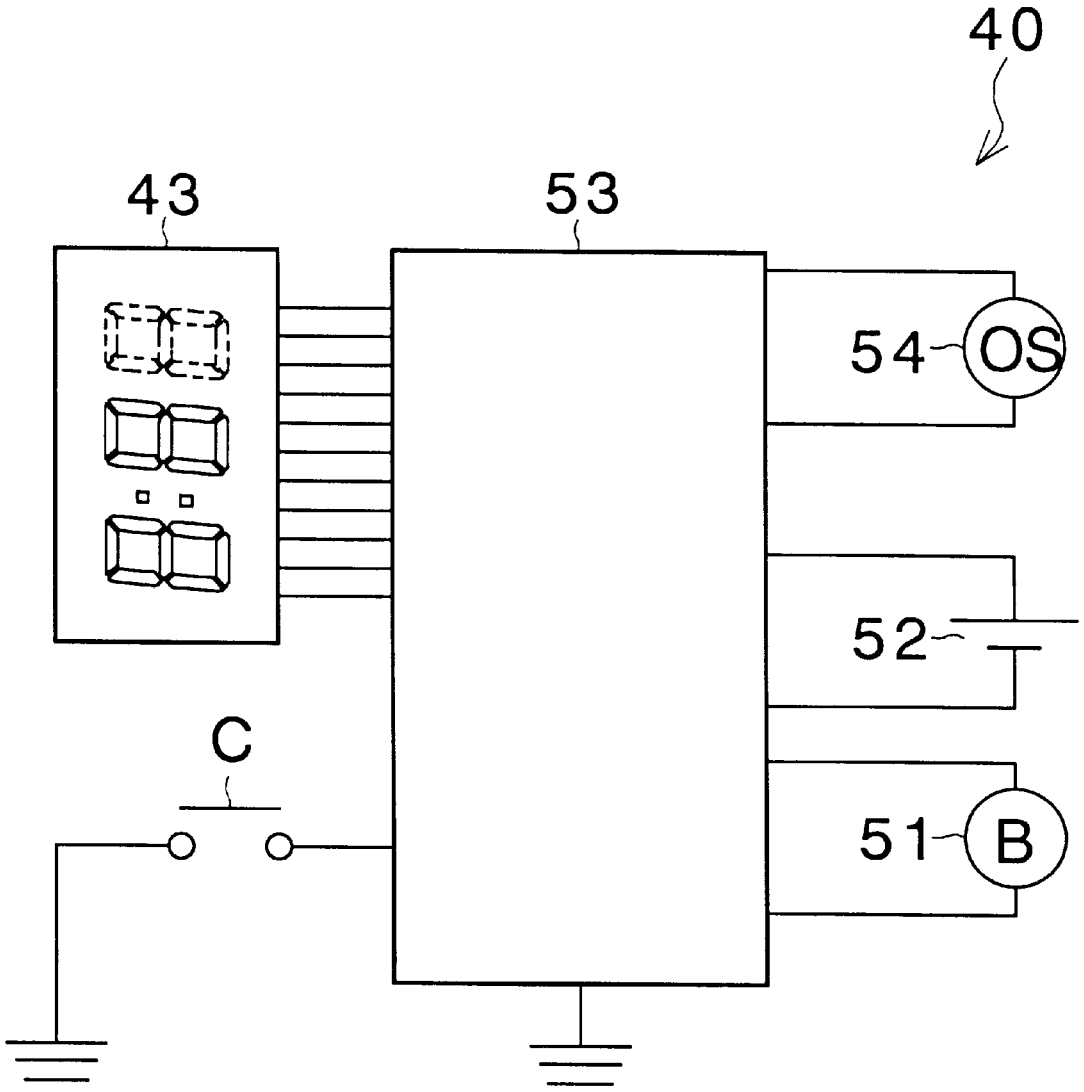
FIG. 3 is a circuit diagram showing a circuit arrangement of the first embodiment.
Figure 4:
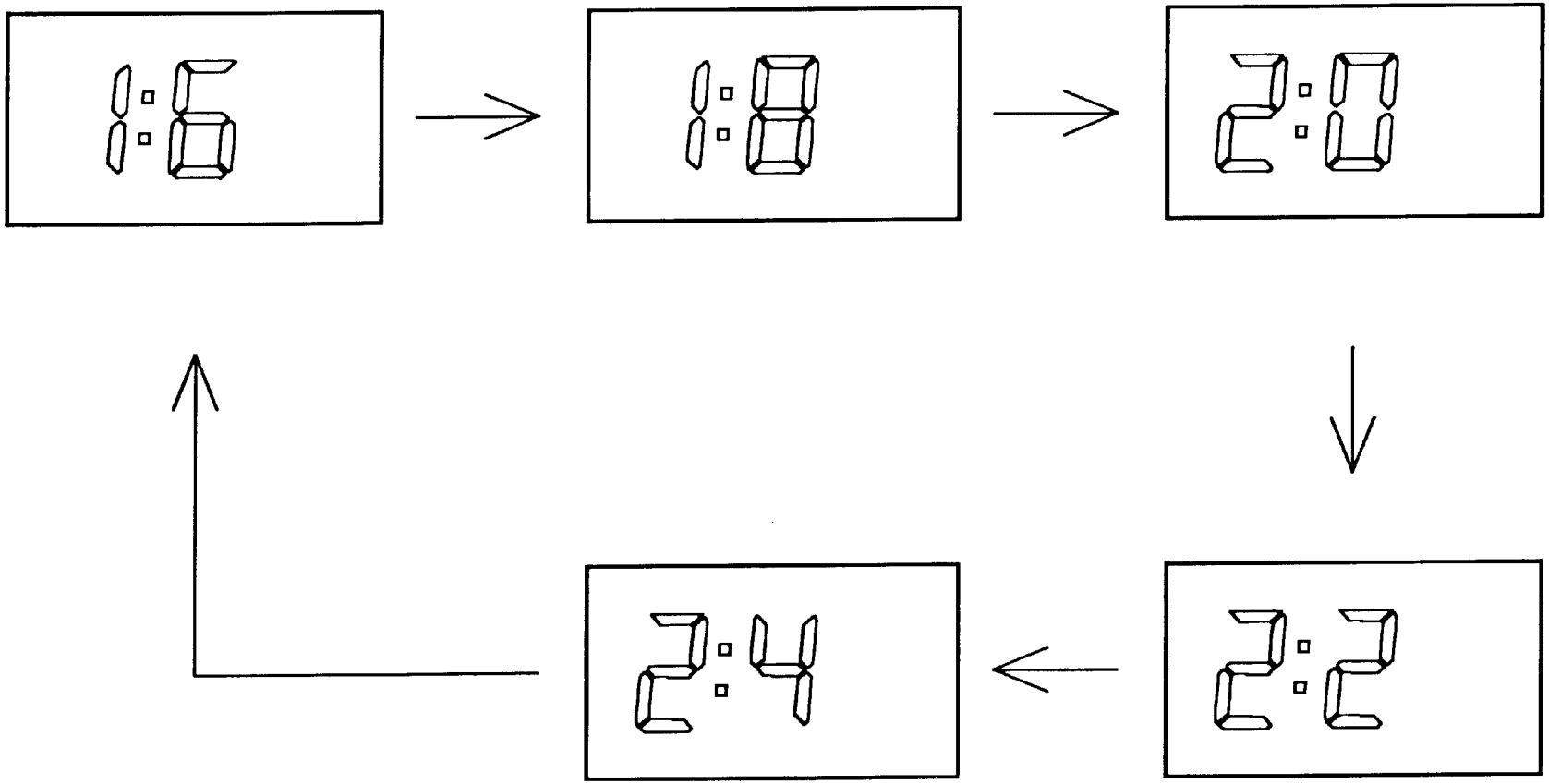
FIG. 4 is a view useful in explaining changes in the screen of a liquid crystal display when a parameter of a rhythm signal is set or changed.
Figure 5:
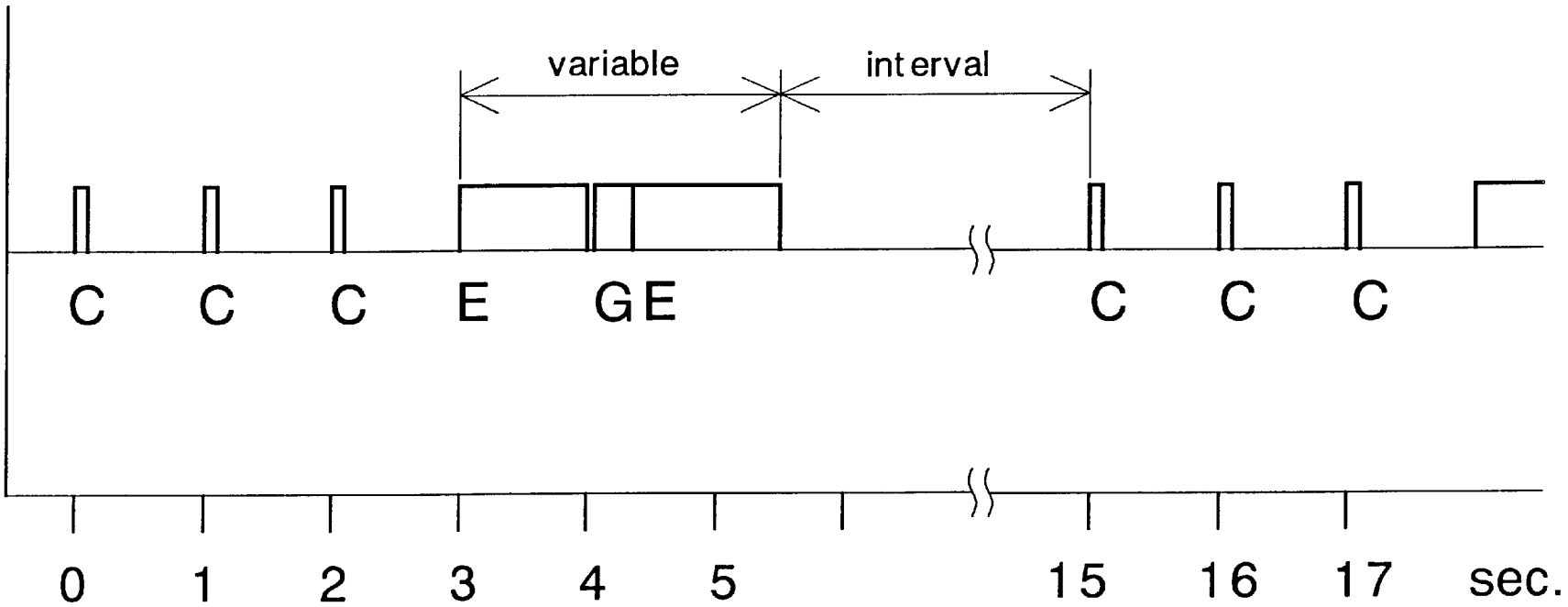
FIG. 5 is a time chart showing a rhythm pattern corresponding to a motion of a golf swing.

A rhythmic tone generator constructed according to the first embodiment of the present invention will be described with reference to FIGS. 1–5. FIG. 1 is a plan view of the rhythmic tone generator, and FIG. 2 is a cross sectional view of the rhythmic tone generator, while FIG. 3 is a circuit diagram of the same. FIG. 4 is a view useful in explaining an example of liquid crystal display when setting is changed. FIG. 5 is a time chart illustrating a rhythm pattern generated by the rhythmic tone generator.

In this embodiment, the rhythmic tone generator 40 is particularly used for generating rhythm for golf players, and may be operated in a simple manner, using only one button.

Referring first to FIGS. 1 and 2, the rhythmic tone generator 40 of the first embodiment includes a casing that is composed of an upper casing 47 and a lower casing 48, which are joined to each other by a hook 62 and a screw 49. The rhythmic tone generator 40 includes only one switch C disposed on the outer surface of a head portion 42 thereof, and a liquid crystal display 43 disposed on the outer surface of an arm portion 44 thereof. The liquid crystal display 43 is adapted to display a numeral value of two digits. A buttery case 61 that houses a battery 52 is rotatably supported by the head portion 42, such that the battery 52, when replaced by a new one, may be taken out of the case with the battery case 61 rotated toward outside the head portion 42.

As shown in FIG. 2, the head portion 42 protrudes downwards from the arm portion 44, such that its lower surface provides a stepped portion 42A. A support portion 46A extends from one of opposite end portions of the arm portion 44 that is remote from the head portion 42, in the same direction in which the head portion 42 protrudes. A clip 45 is rotatably coupled to a shaft 46 that is inserted through the distal end portion of the support portion 46A. The clip 45 includes a spring plate 45A that separates from the middle part of the main body of the clip 45, and rides on one corner of the support portion 46A. When the clip 45 is rotated a little from the state illustrated in FIG. 2 in the opening direction, the spring plate 45A exerts a bending stress on the main body of the clip 45, so as to generate a relatively weak pinching force between the opposed faces of the clip 45 and arm portion 44. The construction and function of the clip 45 are similar to those of a clip of a timer device as disclosed in Japanese Patent Laid-open Publication No. 9-105788 filed in 1995 and published in 1997.

The size of the head portion 42 of the rhythmic tone generator 40 is smaller than that of the recess around the ear hole, but larger than the diameter of the ear hole. With the head portion 42 being placed in the recess around the ear hole, the rhythmic tone generator 40 is attached to between the arm portion 44 and the clip 45 so as to sandwich the concha between in its thickness direction. In this state, the stepped portion 42A provided between the head portion 42 and the arm portion 44 engages with the edge of the recess of the concha, and the arm portion 44, clip 45 and the stepped portion 42A of the head portion 42 cooperate with one another to restrict the cartilage of the concha in four directions.

Accordingly, the rhythmic tone generator 40 may be mounted on the ear without being inserted into the ear hole, while the head portion 42 is kept from pressing the recess of the ear.

In addition, although the clip 45 exerts relatively weak pinching force to the concha, the rhythmic tone generator 40 does not fall off from the ear even when the user is running or has his/her head strongly shaken.

As will be described later, an electronic buzzer 51 is disposed in the lower surface portion of the head portion 42, to provide a sound generating portion that is positioned adjacent to the inlet of the ear hole by the arm portion 44, clip 45, and the stepped portion of the head portion 42.

This arrangement allows the user to surely and comfortably hear rhythmic sound even if the output of the rhythmic sound is relatively small or the sound is generated in the noisy environment.

Also, the rhythmic tone generator merely loosely grips or pinches the less sensitive concha without being inserted into the ear hole, so that the weight of the main body of the generator (which is equivalent to that of a little heavy earring) is supported by the concha. Thus, the user is free from uncomfortableness or pain even if he/she wears the rhythmic tone generator for a long period of time, or the generator is kept shaken due to motion of the user. Further, if the motion of the user causes a slight movement of the rhythmic tone generator 40, the air in the ear hole is forced to be stirred for ventilation, thus preventing moisture or heat from staying inside the ear hole.

Figure 8:
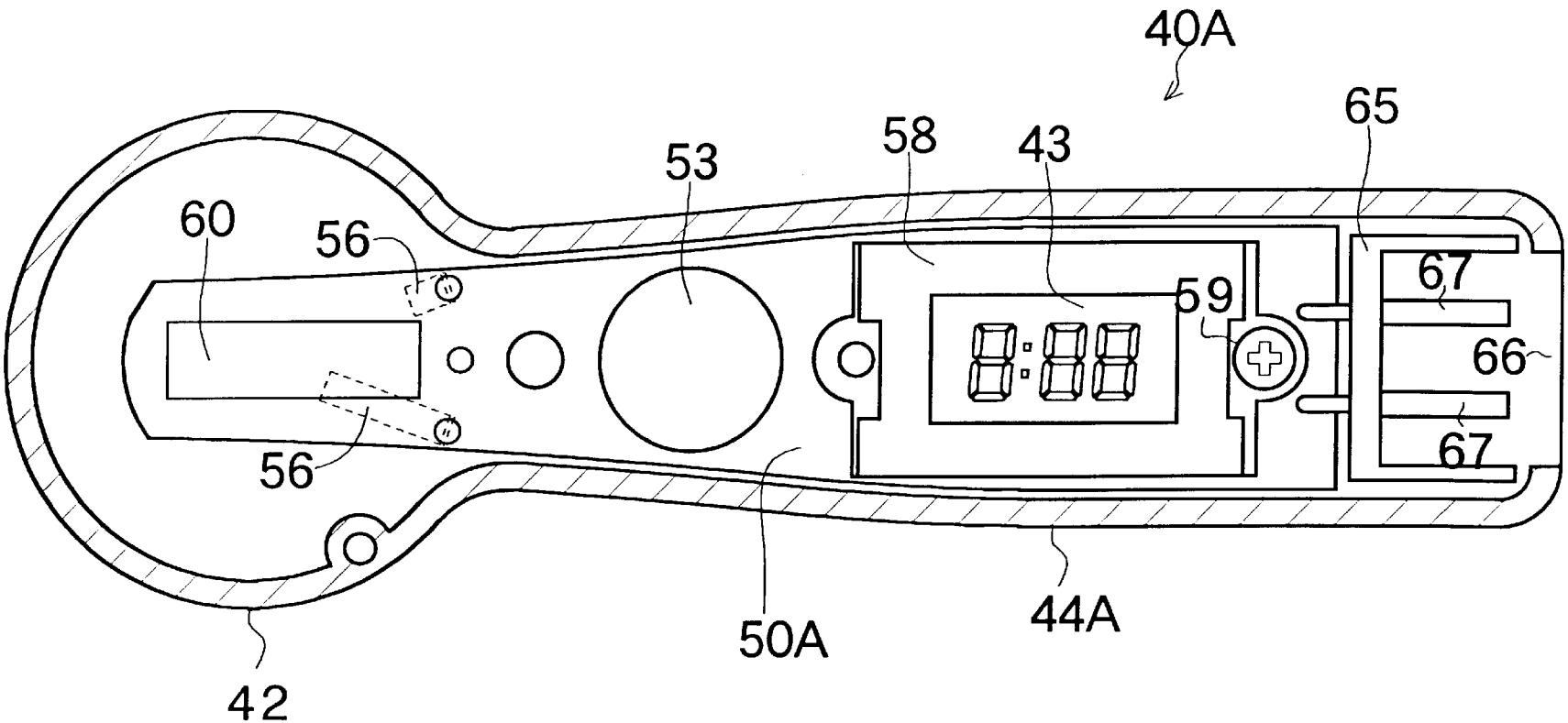
FIG. 8 is a plan view of a rhythmic tone generator according to the third embodiment of the present invention.

The casing further incorporates a printed board 50, a lithium buttery 52, a quartz oscillator 54, an electronic buzzer 51 and others. On the circuit board 50 are mounted a microcomputer circuit 53, a switch contact 60, and an LCD housing 58. The LCD housing 58 houses a liquid crystal display 43 and its accessories, and is fastened onto the circuit board 50 by a pair of screws 59. The electronic buzzer 51 is bonded to the lower casing 48, and receives a rhythm signal from the microcomputer circuit 53 via the printed board 50 and a pair of buzzer contacts 56 (as shown in FIG. 8). An electric power is supplied from the lithium battery 52 via a pair of battery contacts 55, 57. When the battery case 61 is rotated to be placed in the head portion 42, the battery contacts 55, 57 come into contact with the side face of the lithium battery 52. The microcomputer circuit 53 includes a microcomputer chip (for clock with a melody alarm) which is directly attached to the printed board 50 and to which wires are bonded, and a certain number of external capacitors.

As shown in FIG. 3, the liquid crystal display 43 capable of displaying at least two digits, switch C, electronic buzzer 51, lithium buttery 52 and quartz oscillator 54 are connected to the microcomputer circuit 53. With an electric power supplied from the lithium battery 52, the microcomputer circuit 53 operates with a clock signal whose frequency is fixed by the crystal oscillator 54. The microcomputer circuit 53 is adapted to determine the ON/OFF state of the switch C, and generate a rhythm signal at a selected speed, to thus actuate the electronic buzzer 51. As shown in FIG. 4, the currently selected speed of the rhythm signal in the form of a two-digit figure in seconds is usually displayed on the liquid crystal display 43.

As shown in FIG. 5, a golf rhythm pattern is formed by arranging a plurality of types of successive tones that correspond to the lengths of respective steps of a golf swing. Initially, preparation tones of C are generated three times at the intervals of one second. The first one of successive tones that follow the preparation tones is an E tone that is two keys higher than the preparation tones and corresponds to a back-swing step. The second one of the above successive tones is a G tone that is 1.5 keys higher than the E tone and corresponds to a down-swing step. The third one of the successive tones is an E tone that is at the same level as the first successive tone, and corresponds to an impact/follow-through step.

While 0.1-second interval is set between the first and second successive tones so that the user can hear these tones as being distinguished from each other, there is no interval between the second and third successive tones. Thus, the user distinguishes the second and third tones from each other only through the difference in the levels of tones.

A rhythm speed parameter of the golf swing takes the form of the number of seconds required for one cycle of golf shot swing (from the back-swing step to the follow-through step), which corresponds to the variable range shown in FIG. 5. The entire time length or duration of the variable range shown in FIG. 5 is longer than the value in seconds (2 sec. in this embodiment) required for one swing, since the third successive tone is somewhat elongated after completion of follow-through, so that the tone sounds natural to the user.

Figure 6:
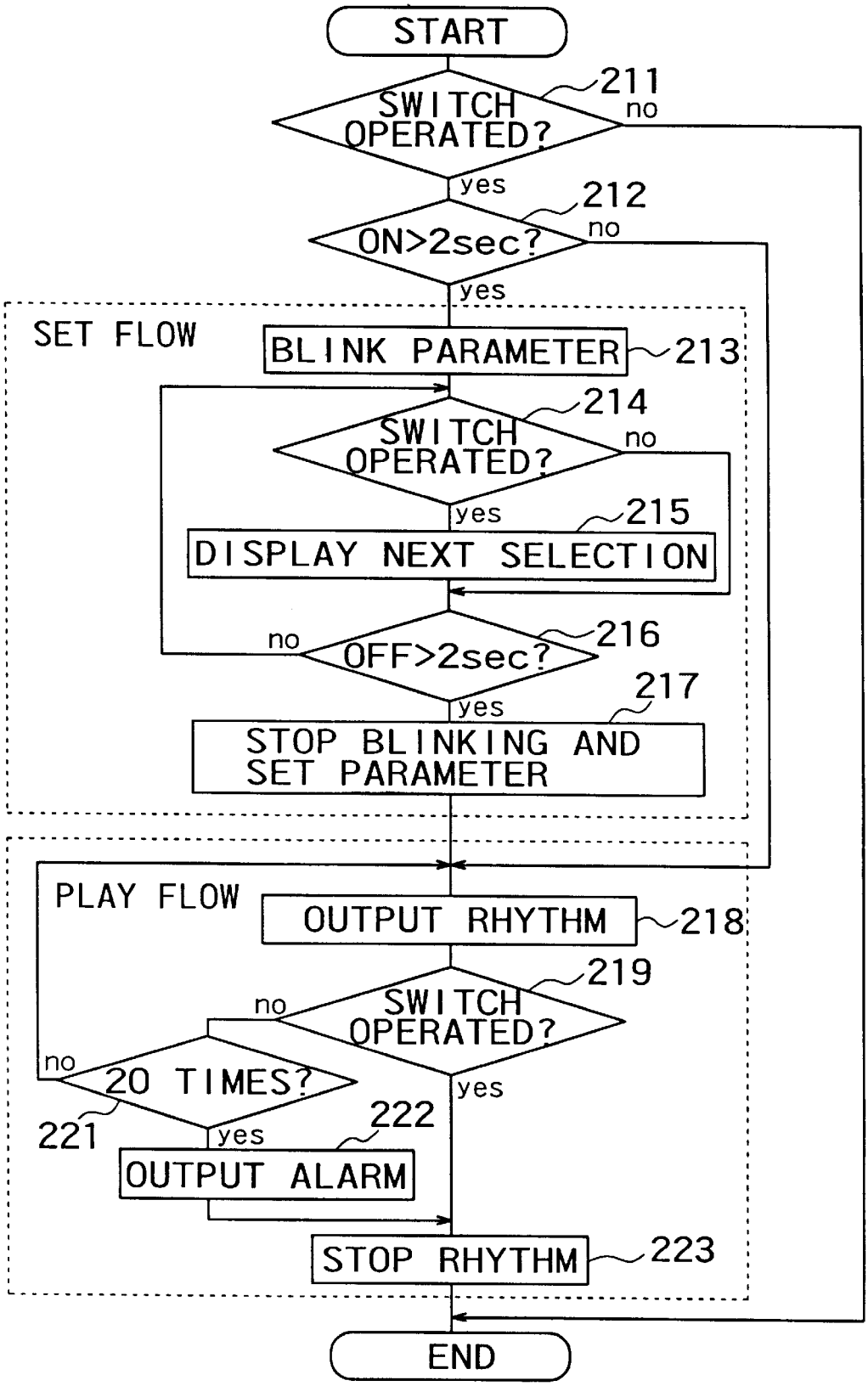
FIG. 6 is a flow chart showing a flow of control operations in the first embodiment.

FIG. 6 is a flowchart that shows a control flow employed in the present embodiment.

When the user presses and releases the switch C, the control flow goes from step 211 to step 212 to determine whether the ON duration of the switch C has exceeded 2 seconds. If the ON duration is equal to or less than 2 seconds, it is determined that a command to start generating rhythmic tones be generated, and a rhythm play cycle of steps 218 through 223 is executed.

In step 218, a rhythm signal corresponding to the last selected parameter representing the swing time in seconds is generated. If the user presses and releases the switch C while the rhythm signal is being generated, the control flow goes from step 219 to step 223 so that the rhythm signal is stopped. If the total number of cycles of the rhythm signal thus generated reaches twenty times of swings, the control flow goes from step 221 to step 222 to generate an alarm signal for five seconds, and then goes to step 223 to stop the rhythm signal even if the switch C is not operated.

If step 212 determines that the ON duration of the switch C is longer than 2 seconds, it is determined that a command to request a change in the parameter be generated, and a setting cycle of steps 213 through 217 is executed.

In step 213, the liquid crystal display 43 starts blinking the currently set value in seconds required for one swing. Step 213 is followed by step 214 to determine whether the switch C is being operated or not. If the user presses and releases the switch C, step 215 is executed to replace the blinking value by the next larger value in seconds required for the slower swing, in the order as indicated by arrows in FIG. 4. If the switch C is operated while the largest value in seconds for the slowest swing is being displayed, the smallest value in seconds for the fastest swing is displayed. Thus, different values in seconds required for one swing are displayed in such a cyclic manner each time the switch C is operated.

Step 216 is then executed to determine whether the switch C is not operated for more than 2 seconds. The control flow also goes to step 216 where no switch operation is detected in step 214. If no switch operation occurs for more than 2 seconds, the setting cycle is automatically finished, and step 217 is executed to stop the blinking display of the liquid crystal display 43, and the previous parameter is replaced by the value in seconds that is being displayed at this point of time. If the duration in which no switch operation occurs is equal to or less than 2 seconds, the control flow returns to step 214, and keeps waiting for the next switch operation until 2 seconds elapses.

In the rhythmic tone generator constructed according to the present embodiment, only one switch C is disposed on the rear surface of the casing, such that the switch C is operable from the outside while the tone generator is being attached to the ear. This arrangement permits the user to find out the switch C with his/her hand and press or release it to surely generate a start/stop command while wearing the tone generator on the ear. Also, the parameter that may be set or changed is limited to only the rhythm speed (the value in seconds required for one swing), and this value is always displayed on the liquid crystal display 43, the user is able to instantly understand what pattern of rhythmic tones will be generated. In practicing golf swings, other parameters are not so important if the rhythm speed can be changed depending upon the user's physical strength or skill, and therefore the above selection is reasonable.

Further, since rhythmic tones of the parameter set in the last control cycle are repeatedly reproduced each time the switch C is depressed, there is no need to reset the parameter upon each start of the rhythmic tone generator, and the same rhythmic tones as used last time can be used for the current operation.

Since interruption of the operation of the switch C for certain seconds is determined as an operation to confirm the set parameter, no other independent confirming operation is needed, and the rhythmic tone generator is sure to return to the state in which it is ready to generate rhythmic tones even if the tone generator is left unattended with no confirming operation performed.

The speed parameter is changed starting with the current speed parameter value, which is replaced by other values one at a time while the user is looking at the value currently displayed on the liquid crystal display 43. This eliminates a need to record or remember the content that is currently set. Thus, no complicated operation or thought is required, and the parameter can be easily set to a more preferable value to the current one.

In the present embodiment, the combination of the liquid crystal display 43 and the switch C as a parameter selecting device requires a smaller volume of the casing to be occupied and reduced number of contacts, as compared with the case where a multiple dip switch, a rotary switch with a scale, or a dial is used. As a result, the small sized casing is easily obtained.

Moreover, no scale nor characters need to be placed on the rear surface of the casing, and the user is able to determine the set content at a glance with no mistake, using a relatively large display of a numerical value on the small-sized casing.

The switch of the present rhythmic tone generator functions as a start/stop switch and also as a switch for changing the setting. This makes it easy to locate a switch having a suitable size at a desired position, while simplifying the switch circuit.

With the above arrangement, the present rhythmic tone generator can be designed taking good account of its appearance and operability, even under severe restrictions due to the extremely small size of the casing that permits attachment of the tone generator to the ear.

In the above embodiment in which the battery case 61 is rotatably supported by the head portion 42, the battery case 61 may be rotated toward outside the head portion with the upper casing 47 and lower casing 48 joined together, so that the lithium battery 52 can be taken out of the case and replaced by a new one. Thus, there is no need to disassemble the upper casing 17 and the lower casing 18 upon replacement of the battery.

Also, the use of the electronic buzzer 51 leads to reductions in the installation space and weight of the whole device and the power consumed, as compared with the case when a speaker is used. The current consumed by the liquid crystal display 43 and the microcomputer circuit 53 is equal to or less than 1 $\mu$A, even if the liquid crystal display is caused to provide a display all the time. This ensures a sufficiently long battery life (for example, two years or more at the average frequency of use with a lithium cell CR1216).

In the above embodiment, the microcomputer circuit 53 having a small size and a light weight is employed which is capable of performing numerous functions and setting various parameters depending upon a desired type of programming.

Therefore, the present rhythmic tone generator may be used not only for practicing golf swings, but also favorably used in the following cases:

(1) where various other types of rhythmic tones are to be generated at a desired pace so as to meet the need of individuals;

(2) where the rhythmic tones are exclusively used for a particular purpose; and (3) where the same pattern of rhythmic tones is repeatedly used by a particular individual for the same purpose.

For example, the hardware as shown in FIG. 1, FIG. 2, and FIG. 3 and the sequence as shown in FIG. 6 may be used to provide a pacemaker capable of changing only the rhythm speed (the number of pulses per minute).

Figure 7:
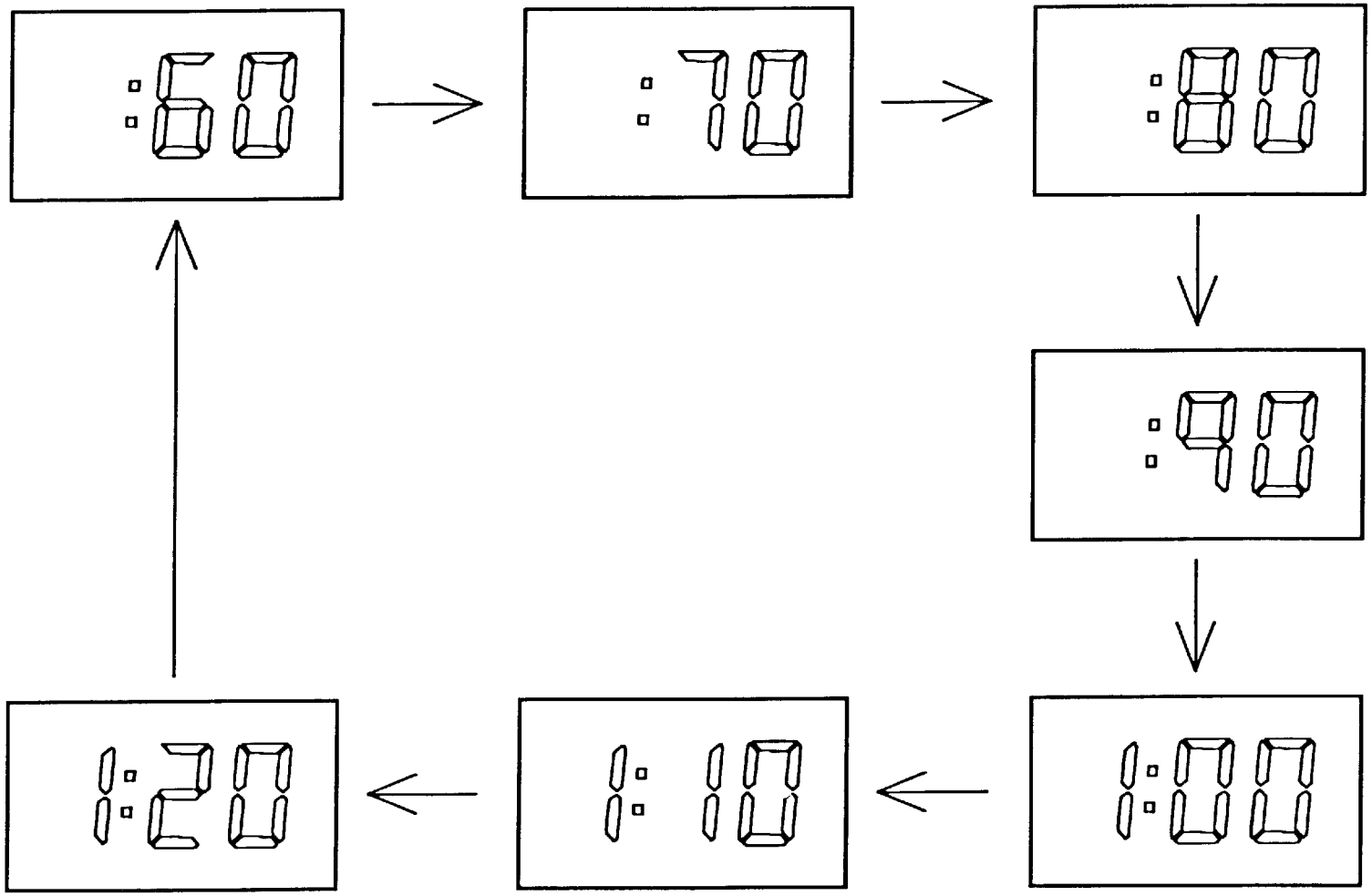
FIG. 7 is a view useful in explaining changes in liquid crystal display in the second embodiment in which the present invention is applied to a pacemaker.

FIG. 7 illustrates an example of display by liquid crystal display of a pacemaker according to the second embodiment as a modification of the first embodiment as described above.

In the pacemaker of the second embodiment, the microcomputer circuit 53 (microcomputer chip) is used for setting a program to generate a rhythm pattern so that pulse tones of the same key are repeated at fixed or constant intervals. The number of pulses per minute that corresponds to the rhythm speed is displayed on the liquid crystal display 43, as shown in FIG. 7.

In the rhythm performance cycle (step 218) of the flowchart of FIG. 6, pulse tones having the same key are repeatedly generated at fixed or constant intervals. In step 221, the elapsed time after the rhythm signal starts being generated is measured instead of the number of cycles of the rhythm signal. When the elapsed time reaches a predetermined value (e.g., 60 minutes), the generation of the rhythm signal is automatically stopped, and step 222 is executed to generate a relatively short alarm signal.

In step 213 of the setting cycle as shown in FIG. 6, the liquid crystal display is caused to blink the currently set value representing the number of pulses per minute, and the value is increased by 10 at a time as indicated by arrows in FIG. 7 each time the switch C is operated. Once the maximum value, i.e., 120, is reached, the minimum value, i.e., 60, is then displayed. If no operation of the switch C occurs for more than 2 seconds, the control flow goes from step 216 to step 217 to stop blinking the value displayed, and set the speed parameter to the value finally displayed on the crystal liquid display 43.

In the first and second embodiments, only one switch C that is exposed to the outside of the casing is provided, allowing the user to operate the switch C without actually looking at it. It is, however, possible to provide a switch that is not supposed to be manipulated during normal operations, at a particular position on the outer surface of the casing or within the casing, so that the switch will not be operated by mistake while the rhythmic tone generator is being attached to the ear. This switch may be used to place the tone generator in a selected one of a first mode for generating rhythmic tones for golf swings as in the first embodiment, and a second mode for generating pulses of a pacemaker as in the second embodiment.

Also, instead of using simple pulse tones of the same key as in the second embodiment, a plurality of duple-time or triple-time rhythm patterns as a combination of pulse tones having different keys may be prepared, and one of these patterns may be selected through the above switch.

In place of the switch that can be directly operated on the outer side of the casing, it is possible to provide other communications device, such as an optical communications connector that allows remote control, or a connector for an external switch.

Figure 9:
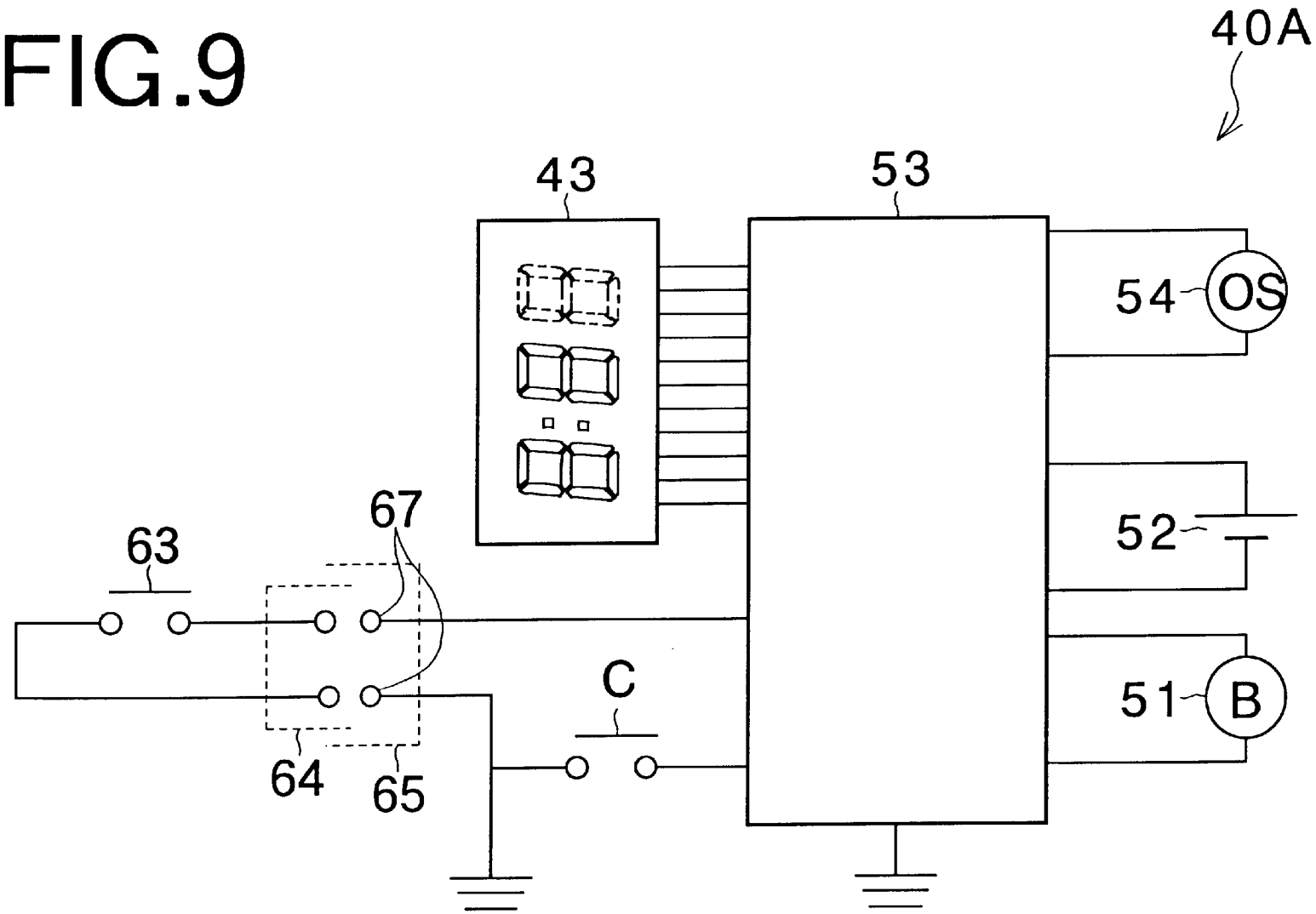
FIG. 9 is a circuit diagram showing a circuit arrangement of the third embodiment.

FIG. 8 is a plan view showing a rhythm tone generator according to the third embodiment as a modification of the first embodiment, and FIG. 9 is a circuit diagram of the tone generator. In FIG. 8 and FIG. 9, the same reference numerals as used in the first embodiment are used to identify the corresponding elements, of which no description will be provided.

In the third embodiment as shown in FIG. 8, an arm portion 44A of the rhythm tone generator 40A is formed by extending the casing in the direction opposite to the head portion 4, and a male connector 65 is accommodated in the extended portion. An opening 66 is formed at the right-hand end portion of the arm portion 44A as viewed in FIG. 8, so as to allow a female connector 64 (FIG. 9) to be inserted into the male connector 65. The opening 66 is normally closed by a rubber cap (not shown).

The positional relationship and structure of the head portion 42 and the clip 45 (not shown in FIG. 8) are similar to those of the first embodiment, assuring the same sense of wearing and pinching or gripping force as obtained in the first embodiment. While the present rhythmic tone generator is being attached to the ear, the end portion of the arm portion 44A protrudes a little outwardly of the ear, as compared with that of the first embodiment.

The male connector 65 has two pins 67 one of which is connected to a switch terminal of the microcomputer circuit 53 as illustrated in FIG. 9, via a corresponding pattern on the circuit board 50. The other pin 67 is connected to the earth terminal of the microcomputer circuit 53.

The female connector 64 to be coupled to the male connector 65 is connected to an external switch 63. With the female connector 64 being coupled to the male connector 65, the external switch 63 may be operated to supply a signal to the microcomputer circuit 53 through remote control.

In the third embodiment, the switch C is exclusively used to enter a command signal to start or stop generation of rhythmic tones for golf swing practice. With the female connector 64 coupled to the male connector 65, the external switch 63 is operated to set respective parameters, more specifically, the value in seconds required for one cycle of golf swing (5 levels in the range of 1.6–2.4 seconds), the number of swings performed in each operation (20 levels in the range of 10–200 in increments of 10), and an interval time (4 levels in the range of 0–30 seconds in increment of 10 seconds).

More specifically described, if the external switch 63 is placed in the ON state for 2 seconds, a control mode for setting the value in seconds required for one cycle of swing is established, and the value currently displayed starts blinking. Each time the switch 63 is depressed and released in less than 0.5 seconds after the above mode is established, the value displayed on the liquid crystal display 43 is changed (increased) in the forward direction. If the external switch 63 is kept depressed for additional four seconds, a control mode for setting the number of swings in each operation is established in which the number of swings currently displayed starts blinking. Each time the switch 63 is depressed and released in less than 0.5 seconds after this mode is established, the number displayed on the liquid crystal display 43 is changed (increased) in the forward direction. If the external switch 63 is kept depressed even after the number of swings starts blinking on the display, another control mode for setting the interval time is established when the switch depression time reaches 6 seconds, so that the interval time starts blinking on the display. Each time the switch 63 is depressed and released in less than 0.5 seconds after this mode is established, the interval time displayed on the liquid crystal display 43 is changed (increased) in the forward direction. In any of the above cases, the liquid crystal display 43 stops blinking the parameter displayed thereon if the external switch 63 is not operated for two seconds, and the relevant parameter is set to a value or time that currently appears on the display 43.

While the rhythmic tone generator of the third embodiment is exclusively used for generating rhythmic tones in practice of golf swings, this tone generator may be used exclusively as a pacemaker similar to that of the second embodiment, or used for both purposes, namely, as a tone generator for use in practice of golf swings and a pacemaker one of which may be selected by operating a switch.

When the rhythmic tone generator is used as a pacemaker, for example, a selected one of the following setting modes may be established by operating the external switch 63. If the switch 63 is placed in the ON state for two seconds, a mode for setting the number of pulses per minute can be established. If the switch 63 is placed in the ON state for four seconds, a mode for setting the time can be established. If the switch 63 is placed in the ON state for six seconds, a mode for setting the type of rhythmic tones (e.g., duple time, triple time or the like) may be established. Where the above rhythmic tone generator is used as a golf rhythm generator/pacemaker, one of operating modes may be selected by keeping the external switch 63 ON for 30 seconds, so as to permit the tone generator to operate as a golf rhythm generator or a pacemaker.

In any event, the rhythmic tone generator 40A of the third embodiment is not able to change parameters by itself. Namely, the parameters can be changed only after the external switch 63 is connected to the male connector 65, thus inhibiting the user or wearer from changing parameters at liberty.

The rhythmic tone generator may be provided with a light-receiving element, such as a photo-transistor, in place of the connector 65. In this case, the microcomputer circuit 53 receives a signal as an output of the photodetector, in response to an optical signal transmitted through an optical cable inserted from the outside of the tone generator, and rewrites parameters or data. The light-receiving element may be disposed on the surface of the casing to be exposed to the exterior. Although the light-receiving element is always exposed to external light, it may be constructed not to respond to normally random disturbance light, but respond to one-second-length optical pulses generated at 0.5-second intervals, so as to change the rhythm speed by one step in response to two optical pulses.

In the first through third embodiments of the present invention as described above, the rhythm signal is used for driving only the electronic buzzer 51 to generate rhythmic tones with a small volume. The rhythm signal, however, may also be used to emit light in synchronization with the rhythm signal.

Figure 10:
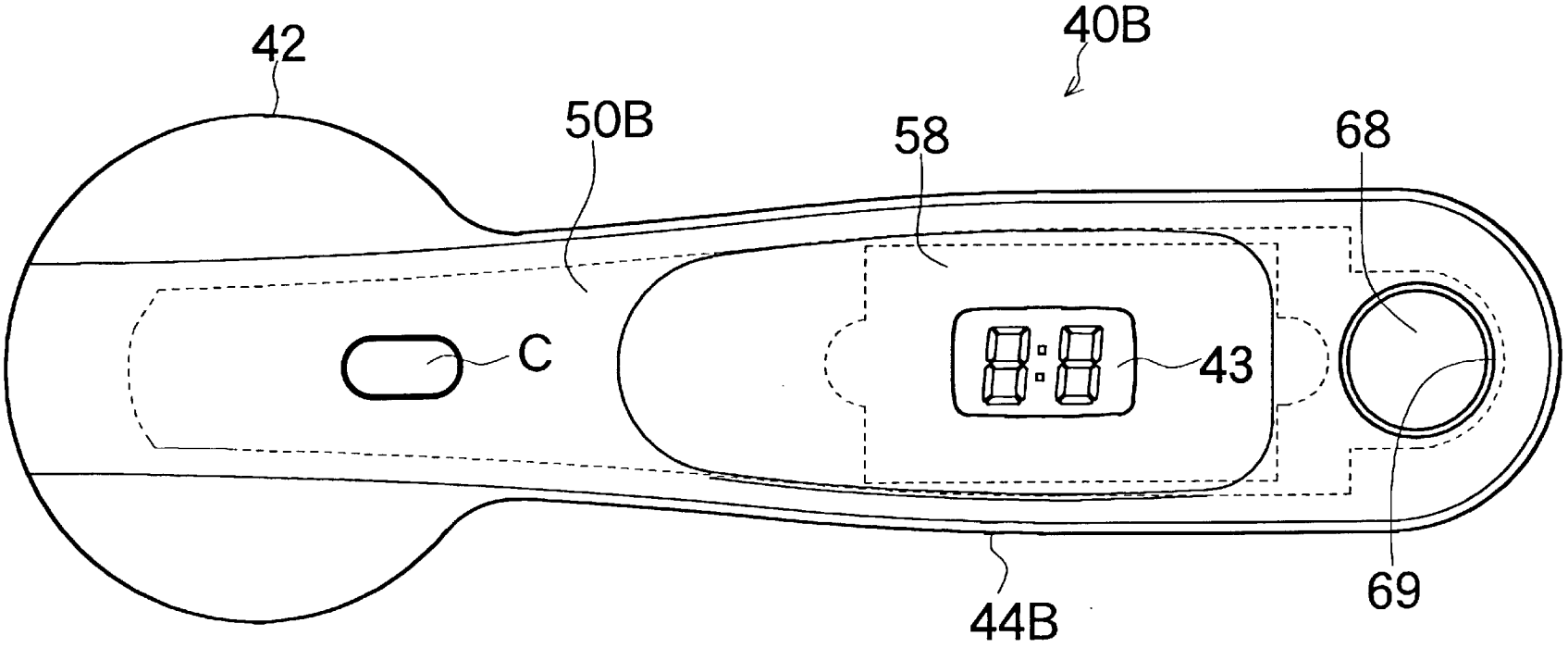
FIG. 10 is a plan view of a rhythmic tone generator according to the fourth embodiment of the present invention.
Figure 11:
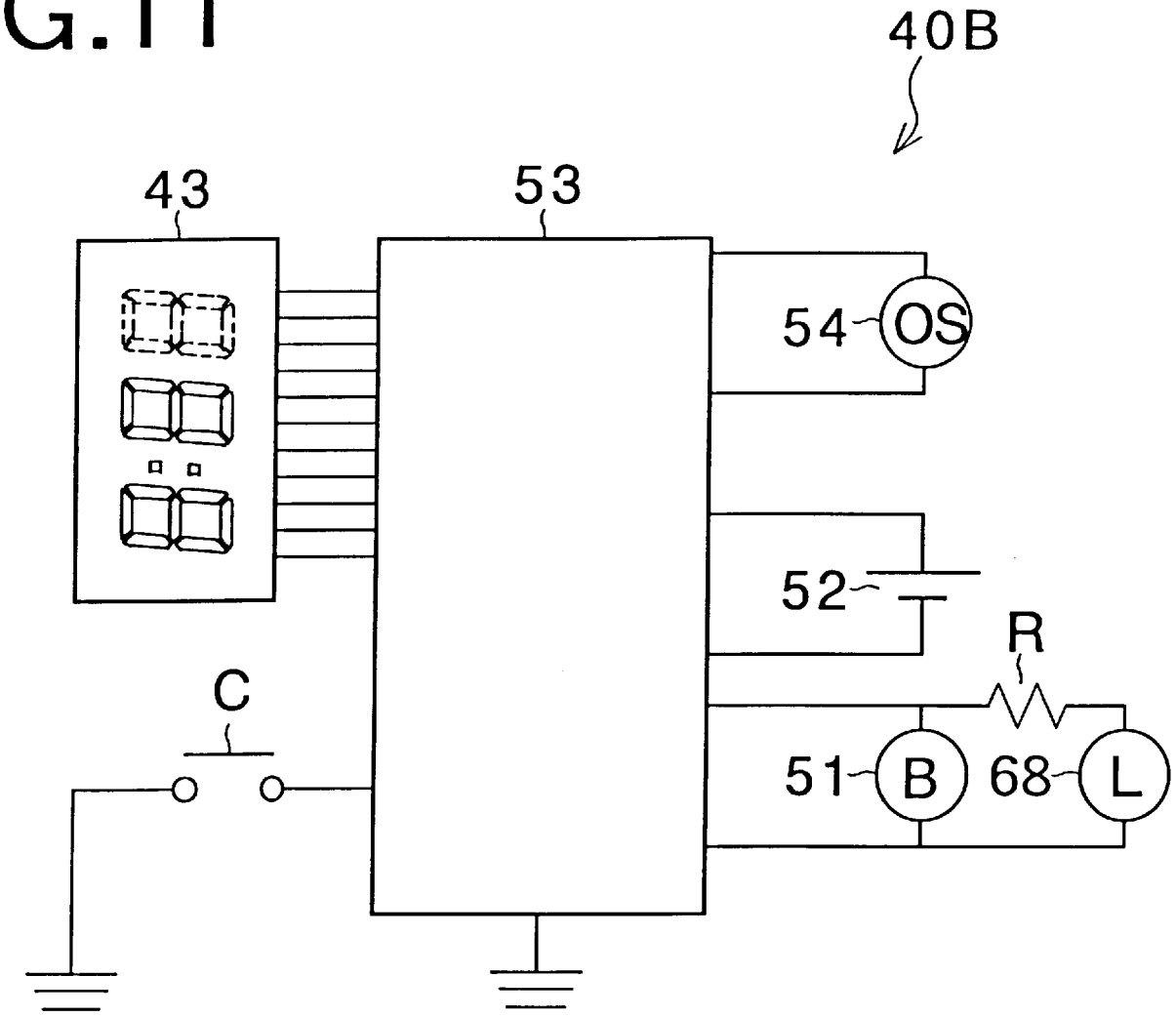
FIG. 11 is a circuit diagram showing a circuit arrangement of the fourth embodiment.

FIG. 10 is a plan view showing a rhythmic tone generator according to the fourth embodiment of the present invention, which is adapted to emit light in response to a rhythm signal, and FIG. 11 is a circuit diagram of the fourth embodiment. In FIGS. 10 and 11, the same reference numerals as used in the previous embodiments are used to identify the corresponding elements, of which no detailed description will be provided.

In the fourth embodiment, an arm portion 44B is formed by extending the casing in the direction opposite to the head portion 42, as shown in FIG. 10. A printed board 50B is extended beyond the LCD housing 58 in the direction away from the head portion 42, and a red-light emitting diode 68 is mounted on the extended portion of the printed board 50B.

An opening 69 is formed through the rear surface of the arm portion 44B such that the opening 69 is aligned with the red-light emitting diode 68. Light emitted by the red-light emitting diode 68 may be observed from the outside through the opening 69. In this embodiment, too, the positional relationship and structures of the head portion 42 and the clip (not shown in FIG. 10 but shown in FIG. 2) are similar to those of the first embodiment, thus assuring the same sense of wearing and gripping or pinching force as obtained in the first embodiment.

As shown in FIG. 11, a series circuit including the red-light emitting diode 68 and a resistance R for limiting current is connected in parallel with the electronic buzzer 51.

When the microcomputer circuit 53 generates a rhythm signal for use in golf swing practice, in which successive pulses are arranged as shown in FIG. 5, the light emitting diode 68 emits light in synchronization with the rhythmic tones generated by the electronic buzzer 51.

The rhythmic tone generator of the present invention is adapted to generate rhythmic tones in the vicinity of the ear of the user, while limiting the volume of the generated tones to a small level, so that people present around the user do not hear the rhythmic tones. In some cases such as a golf lesson, however, there is a need to have someone else make a judgement on matching between the rhythm pattern and the user's swing form. In this case, the person located several meters away from the user can readily recognize the light emitted by the light emitting diode 68. The light generated by the light emitting diode 68 does not disturb people present around the user at all, but only recognized by the person who pays an attention to the user.

While the rhythmic tone generator of the fourth embodiment is used exclusively for generating rhythmic tones in golf swing practice, the rhythmic tone generator used as a pacemaker as explained in the second and third embodiments may be similarly constructed to emit light in synchronization with the rhythmic tones. Such a modification may be accomplished by making minor changes to the program stored in the microcomputer circuit 53, while utilizing the same components or arrangements as used in the first or third embodiment.

What is claimed is:

1. A rhythmic tone generator adapted to be attached to an ear of a user, comprising:

a rhythmic tone generating circuit that generates a rhythm signal comprising a plurality of sets of pulses;

a battery that supplies electric power to said rhythm tone generating circuit;

a tone generating device that is driven by the rhythm signal to generate tones;

a casing that houses said rhythm tone generating circuit, said battery, and said tone generating device; and an attaching device that attaches said casing to a concha of the user so that said casing is located on the concha;

wherein the rhythmic tone generator is attached to the ear without being inserted into an ear hole, so as to generate the rhythmic tones in the vicinity of the ear hole.

2. A rhythmic tone generator according to claim 1, wherein said casing comprises a head portion that may be placed in a recess around the ear hole and having a size that is larger than a diameter of the ear hole, and an arm portion that extends continuously from the head portion to the outside of an edge of the ear;

wherein a clip is connected to a position of said arm portion located outside of the edge of the ear, which clip cooperates with a surface of the arm portion on the side of the ear to sandwiches the concha in a thickness direction thereof; and wherein said attaching device is formed by said casing and said clip.

3. A rhythmic tone generator according to claim 1, further comprising:

a switch device provided on an outer surface of said casing such that the switch can be operated while the rhythmic tone generator is being attached to the ear, said switch device being connected to said rhythmic tone generating circuit and operable to enter a command to start generation of the rhythmic tones.

4. A rhythmic tone generator according to claim 1, further comprising:

a display device provided at a position of said casing which is recognizable from the outside of the casing, said display device being connected to said rhythmic tone generating circuit and adapted to display a parameter representing a rhythm speed; and a switch device provided at a position of the casing that allows the switch device to be operated from the outside of the casing, said switch device being connected to said rhythmic tone generating circuit and operable to enter a command to successively display alternatives of the parameter of the rhythm speed on said display device in a predetermined order;

wherein the parameter of the rhythm speed displayed on the display device by operating said switch device is set in said rhythm tone generating circuit.

5. A rhythmic tone generator according to claim 1, further comprising:

a display device provided at a position of said casing which is recognizable from the outside of the casing, said display device being connected to said rhythmic tone generating circuit and adapted to display a parameter representing a rhythm speed; and a switch provided at a position of the casing that allows the switch to be operated from the outside of the casing, said switch being connected to said rhythmic tone generating, and operable to enter a command to start generation of the rhythmic tones, and also operable to enter a command to successively display alternatives of the parameter of the rhythm speed on said display device in a predetermined order;

wherein the parameter of the rhythm speed displayed on the display device by operating said switch is set in said rhythm tone generating circuit.

6. A rhythmic tone generator according to claim 5, wherein said switch is the only one push-button switch disposed at the position of the casing that allows the switch to be operated from the outside of the casing.

7. A rhythmic tone generator according to claim 6, wherein said rhythmic tone generating circuit is switched from a first mode in which the rhythmic tone generating circuit is able to generate a command to start generation of the rhythmic tones, to a second mode in which the rhythmic tone generating circuit is able to generate a command to successively display alternatives of the parameter of the rhythm speed on said display device in a predetermined order, when said push-button switch is kept depressed for at least a predetermined period of time.

8. A rhythmic tone generator according to claim 1, wherein the rhythm signal has a pattern that corresponds to a predetermined athletic motion.

9. A rhythmic tone generator according to claim 8, wherein the pattern of the rhythm signal is designed to correspond to respective steps of a golf shot swing.

10. A rhythmic tone generator adapted to be attached to an ear of a user, comprising:

a rhythmic tone generating circuit that generates a rhythm signal comprising a plurality of sets of pulses;

a battery that supplies electric power to said rhythm tone generating circuit;

a tone generating device that is driven by the rhythm signal to generate tones;

a display device connected to said rhythm tone generating circuit and adapted to display a parameter value representing a rhythm speed at which the pulses of the rhythm signal are generated;

a casing that houses said rhythm tone generating circuit, said battery, said tone generating device and said display device;

a switch of push-button type provided on an outer surface of said casing such that the switch can be operated with a hand while the rhythmic tone generator is attached to the ear, said switch device being operable to enter a command to start generation of the rhythmic tones; and an attaching device that attaches said casing to a concha of the user so that said casing is located on the concha;

wherein the rhythmic tone generator is attached to the ear without being inserted into an ear hole, so as to generate the rhythmic tones in the vicinity of the ear hole; and wherein said rhythmic tone generating circuit controls said display device to keep displaying the parameter of the rhythm speed that has been set according to a predetermined procedure until the parameter is updated next time, and constantly generates the rhythm signal at the same speed as that represented by said parameter in response to an operation to depress said push-button switch, as long as the parameter is maintained without being updated.

11. A rhythmic tone generator adapted to be attached to an ear of a user, comprising:

a rhythmic tone generating circuit that generates a rhythm signal that indicates the timing of each of a plurality of steps of a golf swing so as to distinguish the steps from each other;

a battery that supplies electric power to said rhythm tone generating circuit;

a tone generating device that is driven by the rhythm signal to generate tones;

a casing that houses said rhythm tone generating circuit, said battery, and said tone generating device;

an attaching device that attaches said casing to the ear of the user so that the casing is held on the ear;

a display device that displays a numerical value such that the value is recognizable from the outside of the casing;

a setting switch device disposed on said casing such that the switch device can be operated from the outside of the casing; and a control device operable to change a speed of the rhythm signal based on a content of operation of said setting switch device, and controls said display device to display a swing period in seconds that corresponds to the speed of the rhythm signal;

wherein the swing period represents a period of time that ranges from a beginning of a back-swing step to an end of a follow-through step in one cycle of golf swing.

12. A rhythmic tone generator adapted to be attached to an ear of a user, comprising:

a rhythmic tone generating circuit that generates a particular type of a rhythm signal at a variable speed;

a battery that supplies electric power to said rhythm tone generating circuit;

a tone generating device that is driven by the rhythm signal to generate tones;

a casing that houses said rhythm tone generating circuit, said battery, and said tone generating device;

an attaching device that attaches said casing to the ear of the user so that the casing is held on the ear;

a setting switch device operable to set a parameter representing the speed of the rhythm;

a display device disposed on said casing and operable to display a numerical value having a plurality of digits; and a speed setting device that stores a plurality of different numerical values from which the parameter of the speed is selected, controls said display device to successively display the numerical values in a predetermined order each time said setting switch device is operated, and sets the speed corresponding to the numerical value displayed last, in the rhythm tone generating circuit.

13. A rhythmic tone generator according to claim 12, wherein said setting switch device is also operable to enter a command to start/stop generation of the rhythm signal;

wherein said speed setting device starts operating when said setting switch device is kept placed in an operated state for at least a predetermined time, so that said display device starts blinking the numerical value currently displayed on the display device; and wherein the display device stops blinking the numerical value when the setting switch device is kept placed in a non-operated state for at least a predetermined time while the speed setting device is operating, and the speed setting device then stops operating.

14. A rhythmic tone generator adapted to be attached to an ear of a user, comprising:

a rhythmic tone generating circuit that generates a particular type of a rhythm signal at a variable speed;

a battery that supplies electric power to said rhythm tone generating circuit;

a tone generating device that is driven by the rhythm signal to generate tones;

a casing that houses said rhythm tone generating circuit, said battery, and said tone generating device;

an attaching device that attaches said casing to the ear of the user so that the casing is held on the ear; and a communication device that transmits a signal to said rhythm generating circuit in response to an operation performed at an external location remote from said casing;

wherein said communication device permits remote control for changing a parameter of the rhythm signal.

15. A rhythmic tone generator according to claim 14, further comprising:

only one push-button type switch that is disposed on said casing such that the switch can be manually operated, said push-button type switch being exclusively used for entering a command to start/stop generation of the rhythmic tones, said communication device being exclusively used for changing the parameter of the rhythm signal.

16. A rhythmic tone generator according to claim 1, further comprising:

a light emitting diode operable to emit light that is recognizable from the outside while the rhythmic tone generator is being attached to the ear, and a light-emitting control device that drives said light emitting diode in synchronization with the rhythm signal, to cause the light emitting diode to emit light upon generation of each of the tones.

17. A rhythmic tone generator according to claim 10, further comprising:

a light emitting diode operable to emit light that is recognizable from the outside while the rhythmic tone generator is being attached to the ear, and a light-emitting control device that drives said light emitting diode in synchronization with the rhythm signal, to cause the light emitting diode to emit light upon generation of each of the tones.

18. A rhythmic tone generator according to claim 11, further comprising:

a light emitting diode operable to emit light that is recognizable from the outside while the rhythmic tone generator is being attached to the ear, and a light-emitting control device that drives said light emitting diode in synchronization with the rhythm signal, to cause the light emitting diode to emit light upon generation of each of the tones.

19. A rhythmic tone generator according to claim 12, further comprising:

a light emitting diode operable to emit light that is recognizable from the outside while the rhythmic tone generator is being attached to the ear, and a light-emitting control device that drives said light emitting diode in synchronization with the rhythm signal, to cause the light emitting diode to emit light upon generation of each of the tones.

20. A rhythmic tone generator according to claim 14, further comprising:

a light emitting diode operable to emit light that is recognizable from the outside while the rhythmic tone generator is being attached to the ear, and a light-emitting control device that drives said light emitting diode in synchronization with the rhythm signal, to cause the light emitting diode to emit light upon generation of each of the tones.

* * * * *